US008820249B2

(12) United States Patent
Tamura et al.

(10) Patent No.: US 8,820,249 B2
(45) Date of Patent: Sep. 2, 2014

(54) BURNER

(71) Applicant: IHI Corporation, Tokyo (JP)

(72) Inventors: Masato Tamura, Tokyo (JP); Shinji Watanabe, Tokyo (JP)

(73) Assignee: IHI Corporation, Tokyo (JP)

( * ) Notice: Subject to any disclaimer, the term of this patent is extended or adjusted under 35 U.S.C. 154(b) by 0 days.

(21) Appl. No.: 14/033,567

(22) Filed: Sep. 23, 2013

(65) Prior Publication Data

US 2014/0057217 A1 Feb. 27, 2014

Related U.S. Application Data

(63) Continuation of application No. 12/786,865, filed on May 25, 2010, now Pat. No. 8,646,394.

(30) Foreign Application Priority Data

May 27, 2009 (JP) ..... 2009-127465

(51) Int. Cl.

| | |
|---|---|
| ***F23C 1/10*** | (2006.01) |
| ***F23D 1/00*** | (2006.01) |
| ***F23C 7/00*** | (2006.01) |
| ***F23D 1/02*** | (2006.01) |

(52) U.S. Cl.

CPC ..... *F23C 7/006* (2013.01); *F23D 1/005* (2013.01); *F23C 7/004* (2013.01); *F23D 1/00* (2013.01); *F23D 1/02* (2013.01); *F23C 7/008* (2013.01)

USPC ..... 110/261; 110/104 B; 110/211; 110/260; 110/262; 110/263; 110/264; 110/265

(58) Field of Classification Search

CPC ..... F23D 1/00

USPC ..... 110/104 B, 211, 260–265, 347

See application file for complete search history.

(56) References Cited

U.S. PATENT DOCUMENTS

| | | | |
|---|---|---|---|
| 1,576,537 | A | 3/1926 | Peabody |
| 2,971,577 | A | 2/1961 | Wallace |

(Continued)

FOREIGN PATENT DOCUMENTS

| | | | |
|---|---|---|---|
| DE | 386159 | C | 12/1923 |
| FR | 1014072 | A | 8/1952 |

(Continued)

OTHER PUBLICATIONS

European Search Report completed Sep. 2, 2010 in corresponding European patent application No. EP 10005491.

(Continued)

*Primary Examiner* — Kenneth Rinehart
*Assistant Examiner* — Gajanan M Prabhu
(74) *Attorney, Agent, or Firm* — Nields, Lemack & Frame, LLC

(57) ABSTRACT

A burner having a secondary air regulator is provided. The secondary air regulator has an end plate having a bored hole penetrating in an axial direction and for forming a cylindrical space with peripheral surface opened in a space with the furnace core side surface of the wind box, a rotary damper having a bored hole penetrating in an axial direction and being capable to open or close the hole on the end plate by rotating in a peripheral direction, a sliding damper for surrounding the cylindrical space and being slidable in an axial direction, air vanes installed at a predetermined distance along circumference of the cylindrical space and for giving swirling to the secondary air, first driving means for rotating the rotary sliding damper, and second driving means for sliding the sliding damper.

19 Claims, 10 Drawing Sheets

(56) References Cited

U.S. PATENT DOCUMENTS

| | | | | |
|---|---|---|---|---|
| 4,702,180 | A | 10/1987 | Kiga | |
| 4,924,784 | A | 5/1990 | Lennon et al. | |
| 4,927,352 | A | 5/1990 | Chung | |
| 4,930,430 | A | 6/1990 | Allen et al. | |
| 5,806,443 | A * | 9/1998 | Kobayashi et al. | 110/262 |
| 5,823,764 | A | 10/1998 | Alberti et al. | |
| 6,145,450 | A | 11/2000 | Vatsky | |
| 7,878,130 | B2 * | 2/2011 | Yamamoto et al. | 110/214 |
| 2005/0211142 | A1 | 9/2005 | Yamamoto et al. | |
| 2010/0018445 | A1 * | 1/2010 | Li et al. | 110/264 |
| 2010/0058961 | A1 | 3/2010 | Fujimori et al. | |
| 2010/0307391 | A1 | 12/2010 | Tamura et al. | |
| 2011/0127355 | A1 | 6/2011 | Tamura et al. | |
| 2011/0139048 | A1 | 6/2011 | Tamura et al. | |

FOREIGN PATENT DOCUMENTS

| | | | |
|---|---|---|---|
| JP | 58-127005 | A | 7/1983 |
| JP | 61-121321 | U | 7/1986 |
| JP | 61-252412 | A | 11/1986 |
| JP | 61-272512 | A | 12/1986 |
| JP | 8-14510 | A | 1/1996 |
| JP | 8-145320 | A | 6/1996 |
| JP | 9-310808 | A | 12/1997 |
| JP | 10-274405 | A | 10/1998 |
| JP | 11-44411 | A | 2/1999 |
| JP | 2005-273973 | A | 10/2005 |
| JP | 2008-205735 | A | 9/2008 |
| JP | 2009-216281 | A | 9/2009 |
| JP | 2010-38519 | A | 2/2010 |

OTHER PUBLICATIONS

Office Action mailed Dec. 26, 2012 in corresponding U.S. Appl. No. 12/786,865.

Final Rejection mailed Apr. 10, 2013 in corresponding U.S. Appl. No. 12/786,865.

Office Action mailed Jul. 17, 2013 in corresponding U.S. Appl. No. 12/786,865.

Notice of Allowance mailed Oct. 4, 2013 in corresponding U.S. Appl. No. 12/786,865.

* cited by examiner

BURNER

This application is a Continuation of U.S. patent application Ser. No. 12/786,865 filed May 25, 2010, which claims priority of Japanese Patent Application No. 2009-127465 filed May 27, 2009, the disclosures of which are incorporated herein by reference.

BACKGROUND OF THE INVENTION

The present invention relates to a burner, being installed on a wall surface of a boiler furnace and used for burning fuels such as pulverized coal, fuel oil, heavy oil, etc.

The wall surface of the boiler furnace is composed of heat exchanger tubes and a multiple of burners to burn the fuels such as pulverized coal, fuel oil, heavy oil, etc. in the furnace are installed on the wall surface of the boiler surface.

FIG. 10 is a schematical drawing to show a boiler, which uses pulverized coal as the fuel.

In the figure, reference numeral 1 denotes a furnace of a coal fired boiler, and pulverized coal burner groups 2 are arranged in a number of stages (3 stages shown in FIG. 10) on a lower portion of the furnace 1. Each of the pulverized coal burner groups 2 has a pulverized coal burner 3 arranged as many as required in horizontal direction along the wall surface.

On an upper portion of the pulverized coal burner groups 2 (downstream side), over air port groups 4 are installed in as many stages as required (one stage shown in the figure). Each of the over air port groups 4 comprises an over air port 5 arranged as many as required in horizontal direction. Each of the over air ports 5 is provided respectively so that it is positioned vertically above each of the pulverized coal burner 3.

To the pulverized coal burner groups 2, a combustion air is supplied via combustion air supply routes 6 and 7. Further, the air for two-stage combustion is supplied to the over air port group 4 via a combustion air route 8 for over air port which branches from the combustion air supply route 6. Pulverized coal is supplied together with the combustion air to the pulverized coal burner 3 from a coal pulverizer (not shown).

Dampers 9 and 10 for adjustment of an airflow rate are installed on the combustion air supply route 7 connected to the pulverized coal burner 3 and on the combustion air route 8 for the over air port connected to the over air port 5.

Next, referring to FIG. 11, description will be given on an example of a conventional type burner in the pulverized coal burner 3.

In FIG. 11, reference numeral 1 denotes a furnace, and numeral 12 represents a furnace wall of the furnace 1.

A throat 13 is provided on the furnace wall 12, and a wind box 14 is mounted on the furnace wall 12 on a side opposite to the furnace 1. Inside the wind box 14, the pulverized coal burner 3 is mounted concentrically to the throat 13. The combustion air supply route 7 is connected to the wind box 14.

The pulverized coal burner 3 is provided with a nozzle main unit 16, and a secondary air regulator 17 designed to surround a forward end (an end at an inner side of the furnace) of the nozzle main unit 16.

The nozzle main unit 16 comprises an outer nozzle 18 and an inner nozzle 19, which are provided concentrically, and an oil burner 20 which is arranged along a centerline of the inner nozzle 19. Cross-sections of each of the outer nozzle 18 and the inner nozzle 19 are designed in circular form. A fuel guiding space 21 is formed between the outer nozzle 18 and the inner nozzle 19. The fuel guiding space 21 is a hollow cylindrical space and its one end is opened.

A primary air intake tube 22 is communicated with a base (an end opposite to the furnace 1) of the outer nozzle 18 from a tangential direction and the primary air intake tube 22 is connected to a coal pulverizer (not shown). The primary air 24 and the pulverized coal carried in the primary air 24 flow into the fuel guiding space 21 from the tangential direction via the primary air intake tube 22 and are spurted out from a forward end of the fuel guiding space 21 while swirling in inner space of the fuel guiding space 21.

At a base of the inner nozzle 19, one end of a tertiary air intake tube 23 is opened, and the other end of the tertiary air intake tube 23 is opened to the wind box 14. The tertiary air intake tube 23 takes the combustion air to be supplied to the wind box 14 and leads the combustion air to the inner nozzle 19 as an auxiliary air for combustion, i.e. as a tertiary combustion air.

The secondary air regulator 17 comprises an auxiliary air regulating mechanism 25 storing the forward end of the nozzle main unit 16 and a main air regulating mechanism 26 provided concentrically and in multiplexed manner on outside of the auxiliary air regulating mechanism 25.

The auxiliary air regulating mechanism 25 has a first air guide duct 28 with its diameter gradually decreased toward a forward end and also has an inner air vane 29 provided rotatably and in multiple number. The inner air vane 29 is synchronically rotatable via a linking mechanism (not shown), and a tilt angle with respect to the air flow can be variable. The main air regulating mechanism 26 has a second air guide duct 32 with its diameter gradually decreased toward a forward end and also has an outer air vane 33 rotatably provided in multiple number at a regular distance in circumference. The outer air vane 33 is synchronically rotatable via a linking mechanism (not shown) in the same way as inner air vane 29, and the tilt angle with respect to the air flow can be variable.

The forward end of the second air guide duct 32 is continuous to the throat 13. The forward end of the first air guide duct 28 is at a position backward from an inner wall surface of the furnace wall 12, and forward ends of the outer nozzle 18 and the inner nozzle 19 are at the positions further backward from the forward end of the first air guide duct 28.

Now, brief description will be given on the combustion of the pulverized coal burner 3. Together with the primary air 24, the pulverized coal is supplied to a base of the fuel guiding space 21 via the primary air intake tube 22. The primary air 24 flows toward the furnace 1 while swirling in the fuel guiding space 21. When the primary air 24 passes through the fuel guiding space 21, the flow of the air is reduced in size, and the primary air 24 is spurted out from the forward end of the outer nozzle 18. To the wind box 14, the secondary air 34, which is air for combustion, is supplied with its temperature at a value as required. A swirling flow is given to the secondary air 34 by the outer air vane 33, and the secondary air 34 is spurted out to the furnace 1 together with the primary air 24 and with the pulverized coal via the second air guide duct 32.

When the pulverized coal is spurted out to the furnace 1, the pulverized coal is homogeneously mixed while being swirled in the fuel guiding space 21. Then, the temperature of the pulverized coal is risen by the secondary air 34 and is further heated up by receiving radiation heat from the furnace 1. By this heating, volatile matter is released from the pulverized coal. Then, the volatile matter is ignited, and flames are continuously maintained.

A part of the secondary air 34 taken into the secondary air guide duct 32 is sent into the first air guide duct 28 via the inner air vane 29, and the secondary air 34 is spurted out as secondary auxiliary air. The inner air vane 29 is tilted with respect to the air flow, and the swirling flow is given to the secondary air thus taken in.

By the adjustment of the airflow rate of the outer air vane 33, by the adjustment of degree of the swirling flow and the airflow rate by the inner air vane 29, a supplying amount and condition of flow of the secondary air 34 are changed, and burning condition of the pulverized coal is adjusted.

A part of the secondary air 34 is guided to the inner nozzle 19 via the tertiary air intake tube 23 as a tertiary air 35, and the part of the secondary air 34 is spurted out from the inner nozzle 19. By the tertiary air 35 being spurted out, the burning condition of the pulverized coal is adjusted. Therefore, through the adjustment of the secondary air 34 and the tertiary air 35 etc., the burning condition of the pulverized coal is set to the best suitable condition.

In the conventional type pulverized coal burner 3 as described above, the outer air vane 33 and the inner air vane 29 are connected by linking mechanisms respectively. Therefore, in order to assemble the outer air vane 33 and the inner air vane 29 without ricketiness and with higher accuracy, higher fabrication accuracy of parts and delicate assembling procedure by a skilled technician are required. For this reason, higher manufacturing cost is needed, and it is difficult to reduce the cost.

Further, it would be unavoidable that ricketiness is increased over time in the linking mechanisms. As a result, tilt angles of the inner air vane 29 and the outer air vane 33 are changed from the tilt angles in an initial stage, and degree of the swirling may vary widely. When the angles of the inner air vane 29 and the outer air vane 33 are varied in order to change the airflow rate and the degree of the swirling flow, there have been problems in that an angle inputted does not accurately correspond to an actual change, or time lag may be caused in the change of angles of the air vanes 29 and 33. This may lead to a situation that it is difficult to perform adequate burning control with high accuracy.

SUMMARY OF THE INVENTION

To solve the above problems, it is an object of the present invention to simplify a structure and to reduce the manufacturing cost, to prevent the changes over time of the angles of the air vanes, to accomplish the stable swirling flow, to maintain stable burning condition, or to reduce the cost for maintenance.

To attain the above object, the present invention provides a burner, comprising a burner throat installed on a furnace wall, a nozzle main unit installed along central axis of the burner throat, and a secondary air regulator installed at a forward end of the nozzle main unit and for supplying secondary air for combustion toward the burner throat, wherein the secondary air regulator comprises: a first adjusting means for supplying a part of the secondary air as a straight axial flow; and a second adjusting means for supplying the remaining secondary air by giving a swirling degree.

Also, the present invention provides a burner, wherein: the secondary air regulator surrounds a forward end of the nozzle main unit and has a cylindrical space communicated with the burner throat and a peripheral surface of the cylindrical space is opened and an end plate having a hole is provided on an end surface on opposite side of furnace core of the cylindrical space; the first adjusting means has a rotary damper being capable to totally close the hole and capable to adjust opening of the hole, and a first driving means for rotating the rotary damper; and the second adjusting means comprises a sliding damper surrounding the cylindrical space and being slidable in an axial direction, and a second driving means to make the sliding damper slide.

Also, the present invention provides a burner, further comprising a partition plate for partitioning the cylindrical space in an axial direction, and the air vanes, being installed at a predetermined distance along a circumferential direction for the partitioned small cylindrical spaces and for giving swirling to the secondary air, and the air vanes have different tilt angles for each small cylindrical space.

Also, the present invention provides a burner, wherein there is provided pressure adjusting means in other than the small cylindrical space where the air vanes have the smallest tilt angle among the small cylindrical spaces.

Also, the present invention provides a burner, wherein pressure adjusting means is provided in a hole on the end plate.

Also, the present invention provides a burner, wherein axial length of the sliding damper has such a length that at least one of the small cylindrical spaces is blocked.

Also, the present invention provides a burner, wherein the sliding damper comprises a plurality of cylindrical members provided each in form of concentrical multi-circular form, and each of the cylindrical members can slide independently from each other.

Also, the present invention provides a burner, wherein the sliding damper can block the cylindrical space by the plurality of cylindrical members.

Also, the present invention provides a burner, wherein the sliding damper comprises at least three cylindrical members, each of the cylindrical members can slide independently from each other, and the cylindrical space can be opened at an arbitrary position and with an arbitrary width.

Also, the present invention provides a burner, wherein the cylindrical space, being divided to three or more small cylindrical spaces by a plurality of partition plates, the air vanes are installed in each of the small cylindrical spaces, and the air vanes have different tilt angles for each of the small cylindrical spaces.

Also, the present invention provides a burner, wherein the air vanes are installed to stride over between furnace core side of the wind box and the end plate, and the tilt angle of the air vane is changed along an axial direction.

The present invention provides a burner, comprising a burner throat installed on a furnace wall, a nozzle main unit installed along central axis of the burner throat, and a secondary air regulator installed at a forward end of the nozzle main unit and for supplying secondary air for combustion toward the burner throat, wherein the secondary air regulator comprises: a first adjusting means for supplying a part of the secondary air as a straight axial flow; and a second adjusting means for supplying the remaining secondary air by giving a swirling degree. As a result, the swirling flow can be adjusted in wider range, i.e. from condition where there is no swirling to condition of a maximum swirling.

Also, the present invention provides a burner, wherein: the secondary air regulator surrounds a forward end of the nozzle main unit and has a cylindrical space communicated with the burner throat and a peripheral surface of the cylindrical space is opened and an end plate having a hole is provided on an end surface on opposite side of furnace core of the cylindrical space; the first adjusting means has a rotary damper being capable to totally close the hole and capable to adjust opening of the hole, and a first driving means for rotating the rotary damper; and the second adjusting means comprises a sliding damper surrounding the cylindrical space and being slidable in an axial direction, and a second driving means to make the sliding damper slide. As a result, air vanes are manufactured in fixed manner, and the structure of the air vanes is simple. No ricketiness over time occurs, and it is possible to reduce the manufacturing cost, to assure the stable swirling and to accomplish the stable combustion. By supplying the secondary air given the swirling degree from a peripheral direction and by supplying the secondary air without swirling from the axial direction, it is possible to adjust the swirling degree finer than the swirling degree only in the peripheral direction.

Also, the present invention provides a burner, further comprising a partition plate for partitioning the cylindrical space in an axial direction, and the air vanes, being installed at a predetermined distance along a circumferential direction for the partitioned small cylindrical spaces and for giving swirling to the secondary air, and the air vanes have different tilt angles for each small cylindrical space. Accordingly, by adjusting and mixing the airflow rates of the secondary airs with the different swirling degree, it is possible to have a structure where the adjustment of the degree of the swirling flow can be simplified, and the operation can be made simply.

Also, the present invention provides a burner, wherein there is provided pressure adjusting means in other than the small cylindrical space where the air vanes have the smallest tilt angle among the small cylindrical spaces. As a result, it is possible to eliminate a difference of a pressure loss between the secondary airs when different swirling degree are given to the secondary airs and to simplify the adjustment of the airflow rate.

Also, the present invention provides a burner, wherein pressure adjusting means is provided in a hole on the end plate. As a result, it is possible to eliminate a difference of the pressure loss between the secondary airs to be supplied from the peripheral direction and from the axial direction, and to simplify the adjustment of the airflow rate.

Also, the present invention provides a burner, wherein axial length of the sliding damper has such a length that at least one of the small cylindrical spaces is blocked. As a result, the swirling degree of the secondary air to be supplied can be adjusted.

Also, the present invention provides a burner, wherein the sliding damper comprises a plurality of cylindrical members provided each in form of concentrical multi-circular form, and each of the cylindrical members can slide independently from each other. As a result, it is possible to diversify the designing of opening condition of the cylindrical space and to perform different type of air adjustment.

Also, the present invention provides a burner, wherein the sliding damper can block the cylindrical space by the plurality of cylindrical members. Thus, it is possible to stop the supply of the secondary air to the cylindrical space and to eliminate the use of the damper for the secondary air supply system.

Also, the present invention provides a burner, wherein the sliding damper comprises at least three cylindrical members, each of the cylindrical members can slide independently from each other, and the cylindrical space can be opened at an arbitrary position and with an arbitrary width. As a result, it is possible to perform air adjustment in different manner.

Also, the present invention provides a burner, wherein the cylindrical space, being divided to three or more small cylindrical spaces by a plurality of partition plates, the air vanes are installed in each of the small cylindrical spaces, and the air vanes have different tilt angles for each of the small cylindrical spaces. By preparing opening at an arbitrary position and with an arbitrary width on the cylindrical space, it is possible to adjust the airflow rate of the secondary air and the swirling degree of the swirling flow.

Also, the present invention provides a burner, wherein the air vanes are installed to stride over between furnace core side of the wind box and the end plate, and the tilt angle of the air vane is changed along an axial direction. By preparing opening at an arbitrary position and with an arbitrary width on the cylindrical space, it is possible to adjust the airflow rate of the secondary air and the swirling degree of the swirling flow.

BRIEF DESCRIPTION OF THE DRAWINGS

FIG. 2 (A) shows condition where a secondary air regulating hole is totally opened, FIG. 2 (B) shows condition where the secondary air regulating hole is half-opened, and FIG. 2 (C) shows condition where the secondary air regulating hole is totally closed;

DETAILED DESCRIPTION OF THE PREFERRED EMBODIMENTS

Referring to the attached drawings, description will be given below on embodiments of the present invention.

FIG. 1 to FIG. 4 each represents a first embodiment of the invention, each showing a case where the present invention is applied to a pulverized coal burner.

Figure 11:
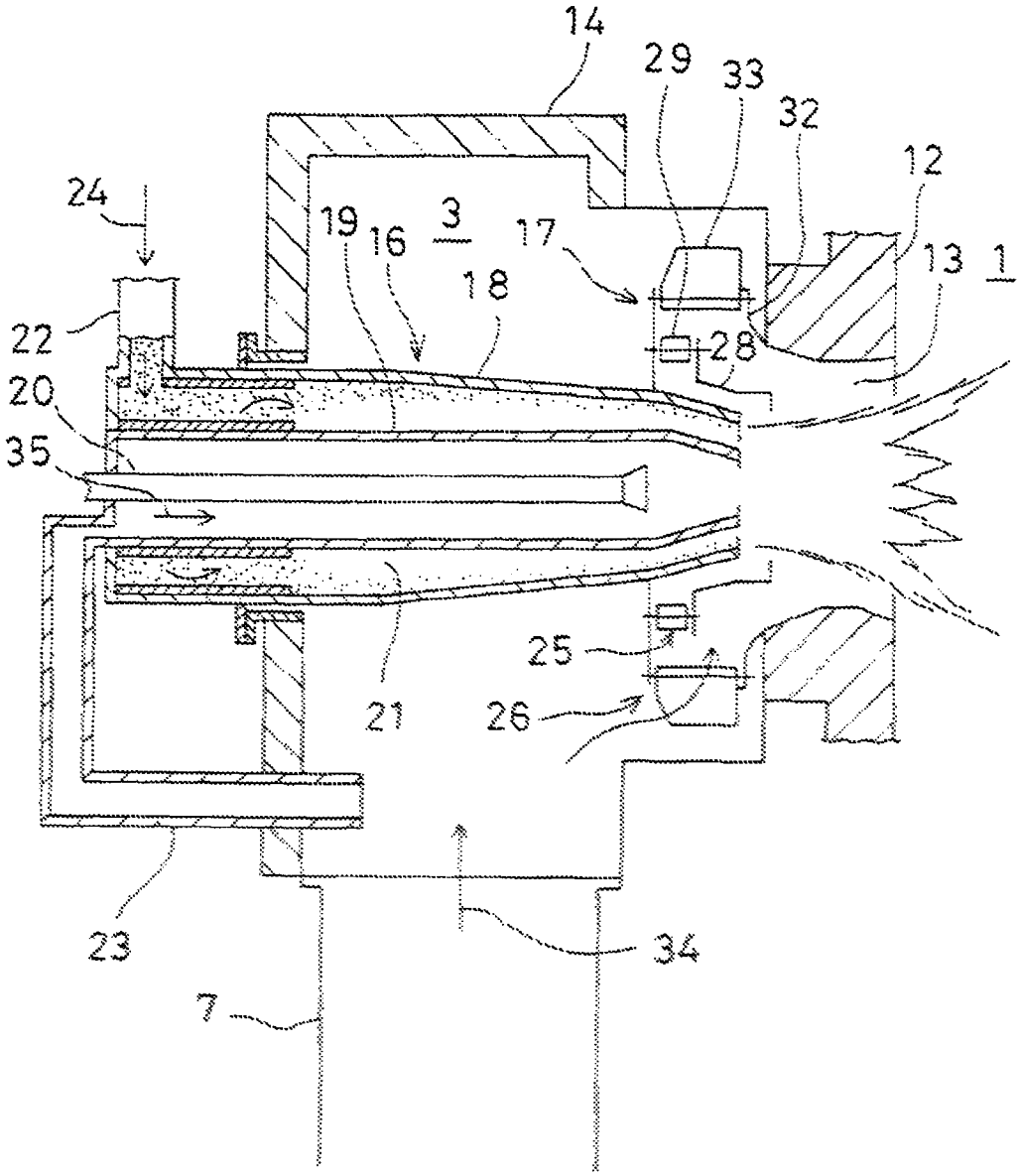
FIG.11 (PRIOR ART)
FIG. 11 is a schematical cross-sectional view to show a conventional type pulverized coal burner.

In the figures, the same component as shown in FIG. 11 is referred by the same symbol, and detailed description is not given here.

A pulverized coal burner 15 is accommodated in a wind box 14, and an air regulator 36 is installed so that the forward end of a nozzle main unit 16 is accommodated in the air regulator 36. A secondary air is taken in from around the air regulator 36 via the wind box 14. Swirling movement is given to the secondary air 34 by the air regulator 36, and the secondary air flows out toward a throat 13. A secondary air 34' is taken in from an axial direction of the pulverized coal burner 15, and the secondary air 34' flows in the axial direction, and the secondary air 34' joins the secondary air 34. By adjusting flow rate of the secondary air 34 from around or from the axial direction, the degree of the swirling flow is regulated.

Next, description will be given on the air regulator 36.

An end plate 37 is mounted on an outer nozzle 18 at a position separated by a certain predetermined distance from a furnace wall outer surface (or a furnace core side surface of the wind box 14) 39 of a furnace wall 12. The end plate 37 perpendicularly crosses a central line of the nozzle main unit 16 and is designed in a disk-like form concentrical to the nozzle main unit 16. On the end plate 37, secondary air intake holes 38 are bored at a predetermined angular distance in the circumferential direction, for instance, at four points at an interval of 90°. Each of the secondary air intake holes 38 is designed in an arcular shape concentrical to the center of the nozzle main unit 16, and a centrical angle is smaller than 45°.

An outer circumference of the secondary air intake hole 38 is at the same position as the position of an internal circumference of a furnace outer side air intake chamber 51 (to be described later) or at a position on a side closer to the center than the internal circumference, and the secondary air intake hole 38 is within a portion where a circumference of the end plate 37 is divided to 8 equal portions.

On furnace outer side of the end plate 37, a rotary damper 42 designed in a disk-like shape, which is concentrical to the end plate 37 and has an outer diameter longer than an outer diameter of the end plate 37, is rotatably provided, and the rotary damper 42 and the end plate 37 can be slid airtightly. On a peripheral edge of the rotary damper 42, a gear tooth is formed, and a pinion gear 44 is engaged with the gear tooth. The rotary damper 42 can be rotated via the pinion gear 44.

Secondary air intake holes 45 are bored, with a predetermined distance in the circumferential direction on the rotary damper 42, e.g. at four points at an interval of 90°. Each of the secondary air intake holes 45 is designed in a similar form or in approximately similar form as the secondary air intake holes 38, and the secondary air intake holes 45 are larger than the secondary air intake holes 38.

The secondary air intake holes 45 are bored at such positions as to be overlapped with the air intake holes 38. Under overlapped conditions, the secondary air intake holes 38 are totally opened without being interrupted by the secondary air intake holes 45. By rotating the rotary damper 42 at an angle of 45° from the overlapped positions, the secondary air intake holes 45 and the secondary air intake holes 38 are mutually half-closed by the end plate 37 and by the rotary damper 42 (see FIG. 2 (B)).

Figure 2A:
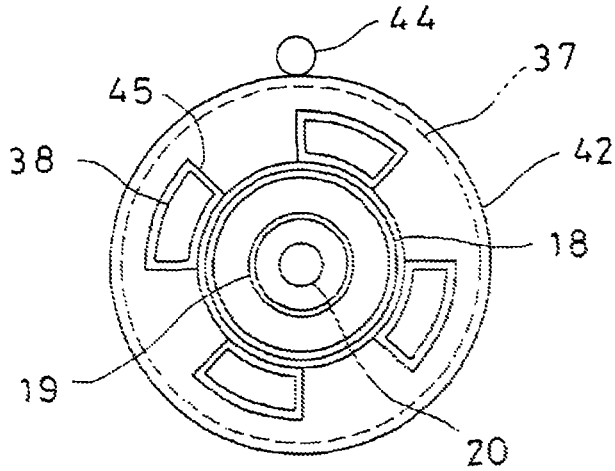
FIGS. 2(A)-2(C) are arrow diagrams along the line A-A in FIG. 1.
Figure 2B:
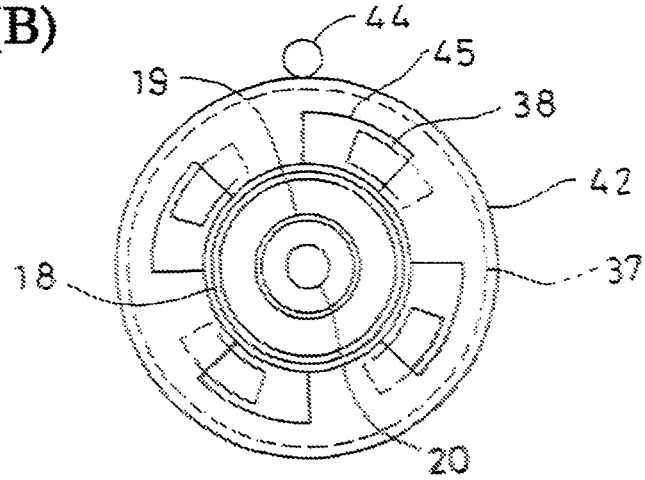
Figure 2C:
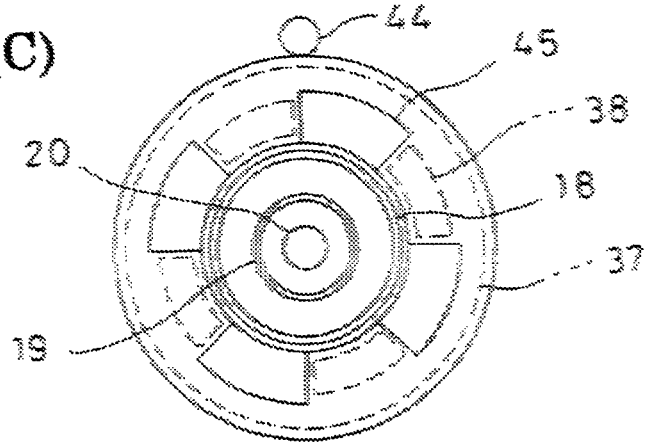
Figure 3:
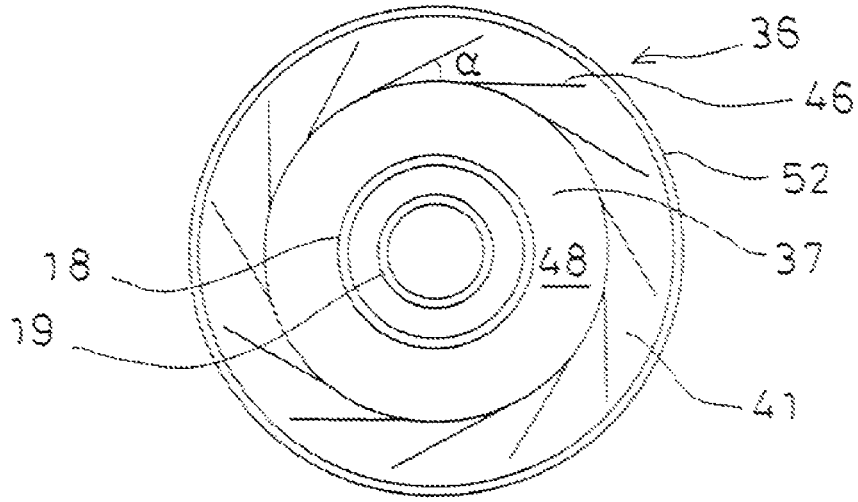
FIG. 3 is an arrow diagram along the line B-B in FIG. 1.
Figure 4:
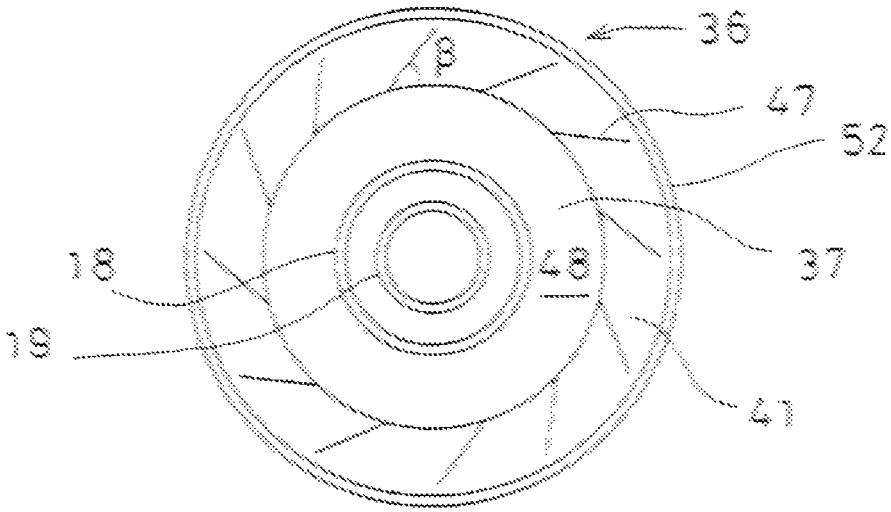
FIG. 4 is an arrow diagram along the line C-C in FIG. 1.

It would suffice that the rotary damper 42 can be rotated from totally opened condition (see FIG. 2 (A)) where the secondary air intake holes 45 and the secondary air intake holes 38 are overlapped each other to totally closed condition (see FIG. 2 (C)) where the secondary air intake holes 45 and the secondary air intake holes 38 are interrupted (shut off) by the end plate 37 and by the rotary damper 42. When the air intake holes 38 and 45 are bored each at four points, gear tooth (not shown) may be formed on the peripheral edge of the rotary damper 42 so that the rotary damper 42 can be rotated at an angle of 90°.

A partition plate 41 in a ring-like shape is fixed between the furnace wall outer surface 39 and the end plate 37, and an outer diameter of the partition plate 41 is the same as the diameter of the end plate 37. First air vanes 46 are provided between the partition plate 41 and the furnace wall outer surface 39 with a predetermined distance in the circumferential direction. An inner end of the first air vane 46 concurs with inner circumference of the partition plate 41 or the inner end is receded toward outer periphery by a distance as required.

Second air vanes 47 are fixed at a predetermined distance in the circumferential direction between the end plate 37 and the partition plate 41. An inner end of the second air vane 47 concurs with an inner circumference of the partition plate 41 or the inner end is receded toward outer periphery by a distance as required.

The first air vanes 46 and the second air vanes 47 are provided at such positions by equally dividing the circumference and are arranged as many as 10 to 40 pieces according to a scale of the pulverized coal burner 15. The first air vane 46 is tilted at a tilt angle $\alpha$ with respect to a tangent of a circle, which passes the inner end of the first air vane 46. The tilt angle $\alpha$ is set in the range of 25°±10° so that the swirling flow can be generated (See FIG. 3). Also, each of the second air vanes 47 is tilted at a tilt angle $\beta$ with respect to the tangent of the circle, which passes the inner end of the second air vane 47, and the tilt angle $\beta$ is set in the range of 45°±10° so that the swirling flow can be generated (see FIG. 4).

Each of the first air vanes 46 and each of the second air vanes 47 are interrupted by the furnace wall outer surface 39 so that these cannot be directly seen from inside the furnace. Therefore, a deterioration to be caused by inner furnace radiation heat is suppressed.

A cylindrical space 48 concentrical to the outer nozzle 18 is formed between the end plate 37 and the furnace wall outer surface 39. An outer peripheral surface of the cylindrical space 48 is opened and the cylindrical space 48 is communicated with inner space of the wind box 14. An outer peripheral portion of the cylindrical space 48 is partitioned to a furnace inside air intake chamber 49 and a furnace outside air intake chamber 51 by the partition plate 41, and the furnace inner air intake chamber 49 and the furnace outer air intake chamber 51 are communicated with each other at an inner peripheral portion.

A sliding damper 52 in a short cylindrical shape is concentrical to the cylindrical space 48 and is provided so as to surround the cylindrical space 48. Width (axial length) of the sliding damper 52 is at least longer than a distance between the partition plate 41 and the end plate 37. The sliding damper 52 is engaged with the end plate 37 and the partition plate 41 and is slidable.

On outer side (opposite side of the furnace) surface of the wind box 14, a first actuator 54 such as a motor is mounted. The first actuator 54 is connected with the pinion gear 44 via a rod 56. By the driving of the first actuator 54, the pinion gear 44 is rotated via the rod 56. Further, via gear teeth (not shown), the rotary damper 42 can be rotated. The first actuator 54, the rod 56, and the pinion gear 44 make up together a first driving means to rotate the rotary damper 42.

Rotational amount of the rotary damper 42, i.e. opening of the secondary air intake hole 38, is detected by an angle detector such as an encoder mounted on the first actuator 54. It may be so designed that a handle is fixed on the rod 56 and the rotary damper 42 may be rotated by manual operation. In this case, an angle scale may be provided to indicate rotational amount of the rotary damper 42 on the outer side surface of the wind box 14. The end plate 37, the rotary damper 42, the first driving means, etc. make up together a first adjusting means for the secondary air.

On the outer side surface of the wind box 14, a second actuator 53, e.g. a hydraulic cylinder, is mounted. The second actuator 53 is connected with the sliding damper 52 via a rod 55. When the second actuator 53 is driven, the sliding damper 52 can be slid. The second actuator 53 and the rod 55 make up together a second driving means to cause the sliding damper 52 to slide.

Also, the furnace inner side air intake chamber 49, the furnace outer side air intake chamber 51, the first air vane 46, the second air vane 47, the second driving means, etc. make up together a second adjusting means for the secondary air.

Next, description will be given on operation of a first embodiment of the invention.

When the secondary air 34 with the given swirling flow is supplied for burning, by moving the sliding damper 52 forward or backward by means of the second actuator 53, the secondary air 34 is blown out via the furnace inner side air intake chamber 49 and via the furnace outer side air intake chamber 51, and the degree of the swirling flow of the secondary air 34 can be adjusted. Position of the sliding damper 52 can be detected by a detector (not shown).

By rotating the rotary damper 42, it is possible to adjust an amount of the secondary air 34, which is supplied from the secondary air intake hole 38 to the cylindrical space 48. The secondary air 34 to be supplied via the rotary damper 42 is sent in straight flow (axial flow) to flow in the axial direction. Through rotation of the rotary damper 42, the amount of the secondary air can be adjusted to prevent the swirling flow. Rotational amount of the rotary damper, i.e. opening degree of the secondary air intake hole 45, can be detected by a detector (not shown).

First, when the secondary air intake hole 38 is totally blocked by the rotary damper 42 (see FIG. 2 (C)), and when the sliding damper 52 is moved backward and a space between the end plate 37 and the partition plate 41 is blocked by the sliding damper 52, the secondary air 34 passes through the first air vane 46. When the secondary air 34 passes through the first air vane 46, the swirling is given to the secondary air 34, and the secondary air 34 flows out to the throat 13 as a swirling flow of the high swirling. Under this condition, the swirling degree reaches the maximum.

When the sliding damper 52 is moved forward, and the space between the partition plate 41 and the furnace wall outer surface 39 is blocked, the secondary air 34 passes through the second air vane 47. When the secondary air 34 passes through the second air vane 47, the swirling is given to the secondary air 34, and the secondary air 34 flows out to the throat 13 as a swirling flow of the weak swirling.

Further, when the rotary damper 42 is rotated and the secondary air intake hole 38 and the secondary air intake hole 45 are overlapped each other to turn to the totally opened condition (see FIG. 2 (A)), a part of the secondary air 34 is supplied to the cylindrical space 48 via the secondary air intake hole 38 without being given swirling. Then, the part of the secondary air 34 flows out to the throat 13 as an axial flow without the swirling flow. Because the axial flow is mixed with the swirling flow, the swirling degree is weakened. The space between the partition place 41 and the furnace wall outer surface 39 is blocked by the sliding damper 52. When the rotary damper 42 is set to the totally opened condition, the swirling degree reaches the minimum.

Figure 1:
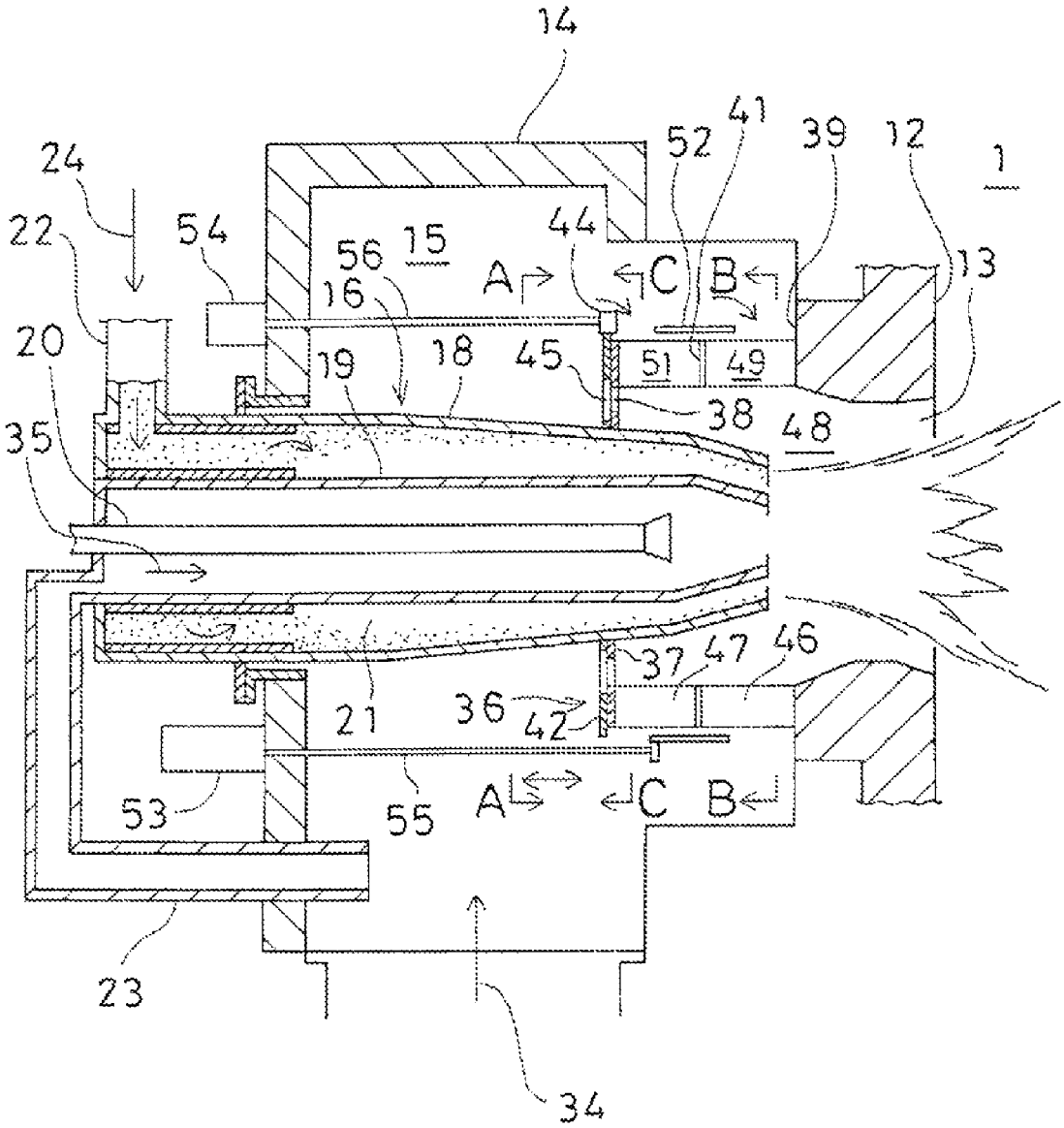
FIG. 1 is a schematical cross-sectional view to show a pulverized coal burner according to a first embodiment of the present invention.

When it is wanted to adjust the swirling degree of the secondary air 34, a combination of two adjusting methods is used. That is, a ratio of the airflow rate into the first air vane 46 to the airflow rate to the second air vane 47 is adjusted by a position of the sliding damper 52, and the flow rate of the axial flow is changed by adjusting the opening of the secondary air intake hole 38 by the rotary damper 42. For instance, the sliding damper 52 is set to an intermediate position as shown in FIG. 1. Each of the furnace inner side air intake chamber 49 and the furnace outer side air intake chamber 51 are partially opened. Then, the secondary air intake hole 45, which is interrupted by the end plate 37, is partially opened.

The part of the secondary air 34 flows into the furnace inner side air intake chamber 49. Further, the part of the secondary air 34 flows into the furnace outer side air intake chamber 51. Then, the remaining air is directly supplied to the cylindrical space 48 via the secondary air intake hole 38 and the secondary air intake hole 45.

A strong swirling flow is given to the secondary air 34 flowed into the furnace inner side air intake chamber 49 by the first air vane 46. A weak swirling flow is given to the secondary air 34 flowed into the furnace outer side air intake chamber 51 by the second air vane 47. After flowing out of the furnace outer side air intake chamber 51, the weak swirling flow joins the strong swirling flow coming out of the furnace inner side air intake chamber 49 and also joins the axial flow coming out of the secondary air intake hole 38.

When the strong swirling flowed from the furnace inner side air intake chamber 49, the weak swirling flowed from the furnace outer side air intake chamber 51, and the axial flowed from the secondary air intake hole 38 join together, each degree of these swirling flows are offset. As a result, the swirling flow, which the swirling degree and the flowing stream (in the axial direction) are adjusted, is supplied to the throat 13.

By adjusting the position of the sliding damper 52 and by adjusting the rotary damper 42, the secondary air 34 from the maximum swirling flow to the minimum swirling flow can be supplied. As a result, it is possible to adjust the burning condition of the pulverized coal burner 15 and to adjust a position of the flame.

In the pulverized coal burner 15 as described above, the first air vane 46 and the second air vane 47 are fixedly installed, and tilt angles of the first air vane 46 and the second air vane 47 are not changed over time. Further, there is no moving component at a point of the connection between the sliding damper 52 and the rod 55. Thus, backlash or looseness does not increase over time. Accordingly, displacement given by the second actuator 53 is correctly transmitted to the sliding damper 52 and a decrease of accuracy over time can be prevented by the positional adjustment of the sliding damper 52. Further, because the rotary damper 42 is rotatably supported, less backlash occurs over time. The influence of the backlash of the pinion gear 44 on the rotation of the rotary damper 42 is small, and the accuracy is not decreased over time.

Figure 10:
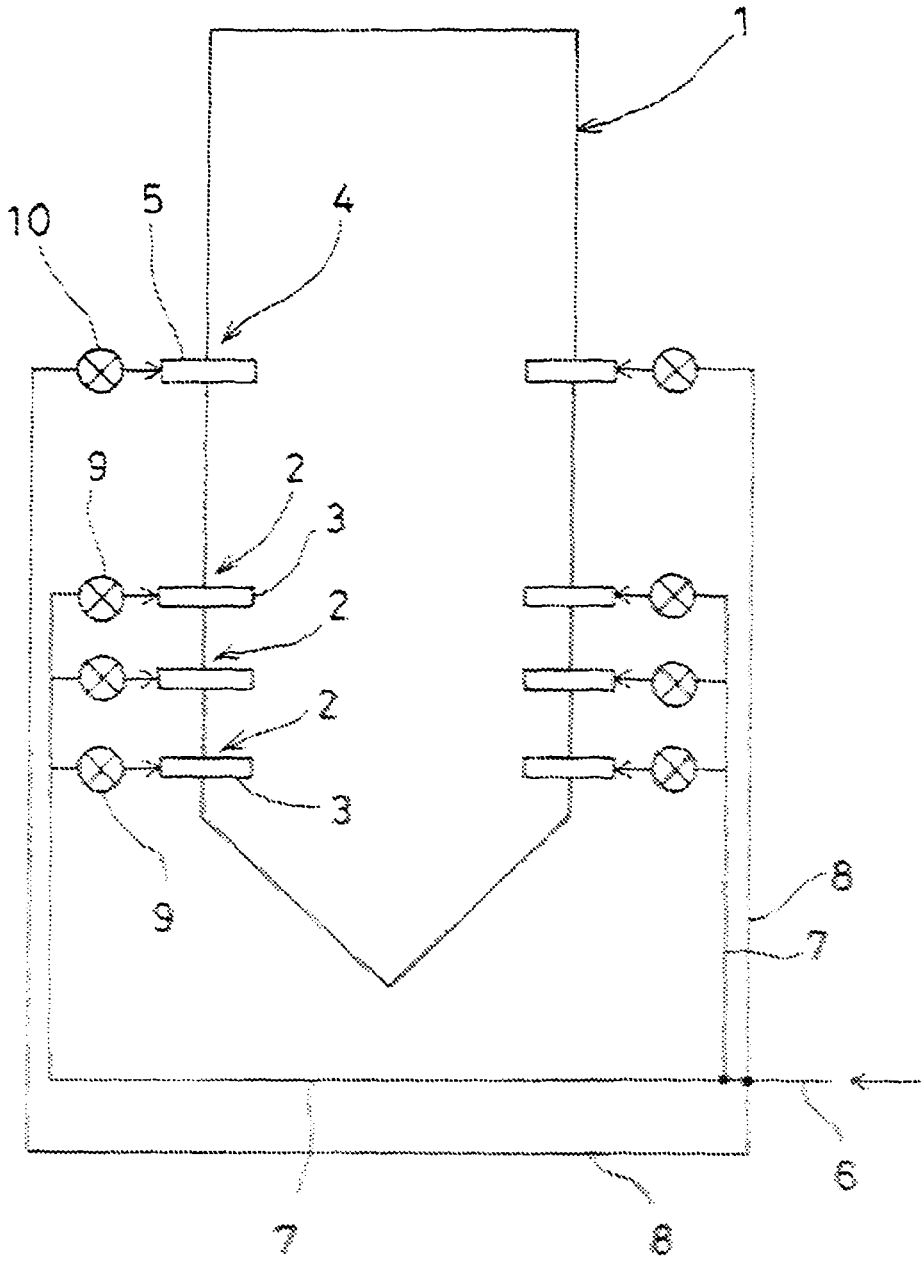
FIG.10 (PRIOR ART)
FIG. 10 is a schematical drawing to explain a coal fired boiler.

In the first embodiment as described above, it may so arranged that either one of the furnace inner side air intake chamber 49 or the furnace outer side air intake chamber 51 (e.g. the furnace outer side air intake chamber 51) is blocked, that opening with respect to the furnace inner side air intake chamber 49 is adjusted by moving the sliding damper 52, and that airflow rate of the secondary air 34 and swirling degree are adjusted by moving the sliding damper 52 and by rotating the rotary damper 42. In this case, the secondary air intake hole 38 and the furnace inner side air intake chamber 49 can be totally closed, and the supply of the secondary air 34 can be stopped. Because the air regulator 36 has a function to stop the supply of the secondary air 34, the damper 9 as shown in FIG. 10 may omit. As a result, it is possible to simplify facilities and a control system.

Figure 5:
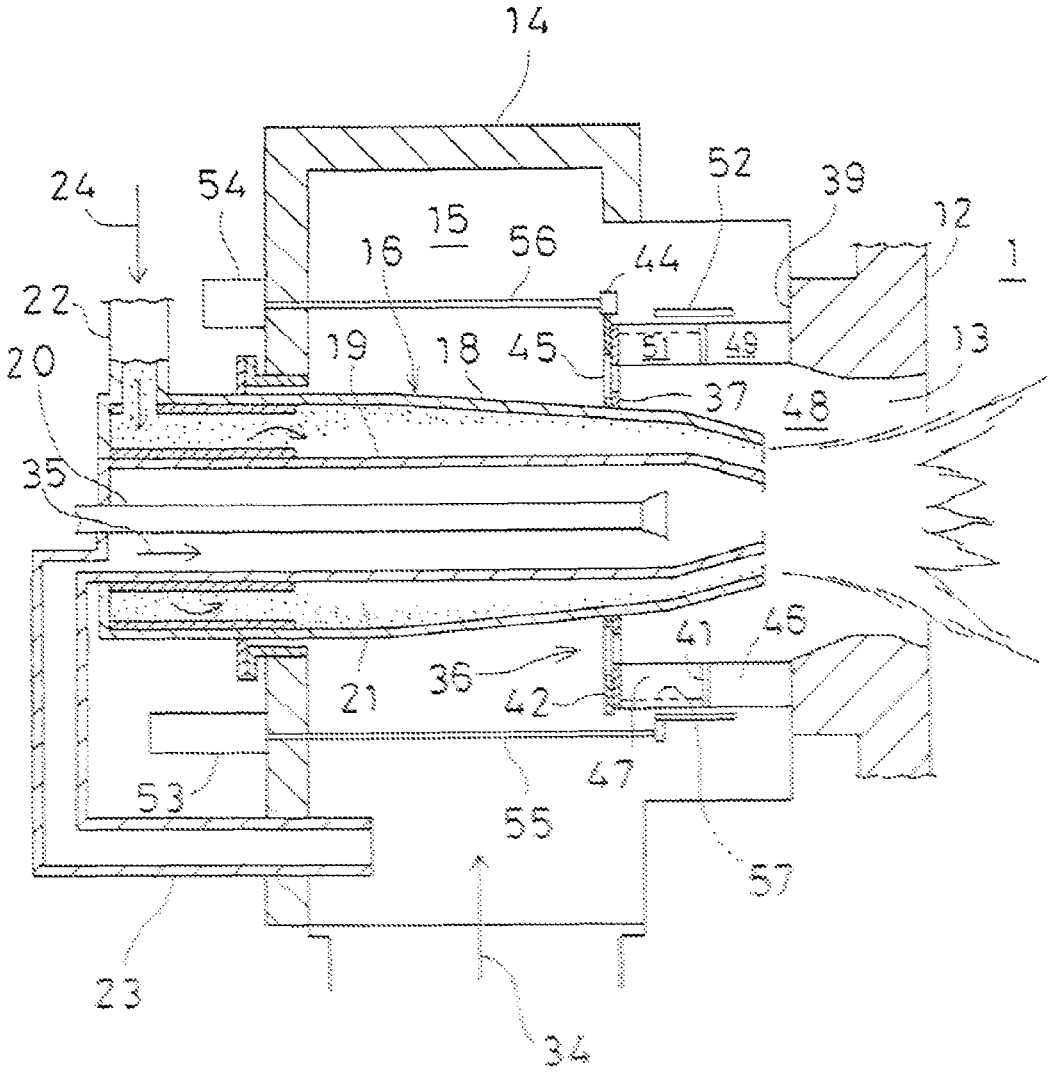
FIG. 5 is a schematical cross-sectional view, showing a pulverized coal burner according to a second embodiment of the present invention.

FIG. 5 shows a second embodiment of the invention. In FIG. 5, the same component as shown in FIG. 1 is referred by the same symbol, and detailed description is not given here.

In the second embodiment, a porous member 57 such as punching metal, net, etc. is installed on a peripheral surface where the furnace outer side air intake chamber 51 is opened.

In condition that the porous member 57 is not installed, as tilt angles are different between the first air vane 46 and the second air vane 47, there are differences in extents of a pressure loss when the secondary air 34 passes through the furnace inner side air intake chamber 49 and the furnace outer side air intake chamber 51. In this respect, there are changes in the supply airflow rate between a case where the furnace inner side air intake chamber 49 is blocked and a case where the furnace outer side air intake chamber 51 is blocked. For this reason, at the time of air adjustment by the sliding damper 52, it is necessary to adjust airflow rate on the supplying side of the primary air 24. Or, it is necessary to adjust the airflow rate or the pressure by an adjusting damper (not shown) (such as a damper 9 shown in FIG. 10) as installed on a supply side of the secondary air 34.

By installing the porous member 57, which fulfills a function as pressure adjusting means, and by equalizing sum of a pressure loss caused by the porous member 57 plus a pressure loss caused by the second air vane 47 with a pressure loss caused by the first air vane 46, it is possible to maintain the rate of the airflow from the air regulator 36 at a predetermined value, regardless of the position of the sliding damper 52.

Further, the porous member 57 is installed on the secondary air intake hole 38, and by equalizing the pressure loss of the secondary air 34 passing through the secondary air intake hole 38 and the secondary air intake hole 45 with the pressure loss caused by the first air vane 46 and with the sum of the pressure losses caused by the second air vane 47 and by the porous member 57, it is possible to maintain the rate of airflow from the air regulator 36 at a predetermined value, regardless of the positions of the sliding damper 52 and the rotary damper 42.

Figure 6:
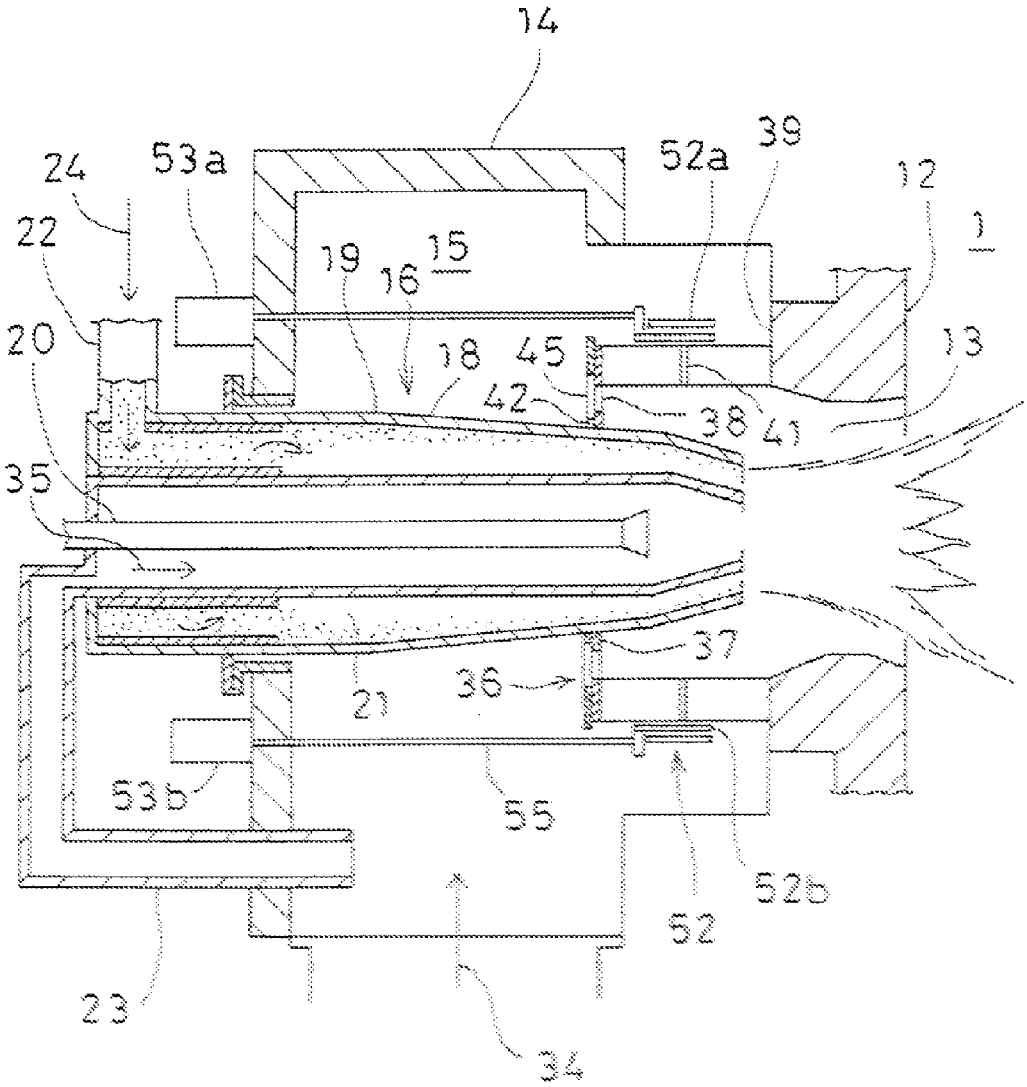
FIG. 6 is a schematical cross-sectional view, showing a pulverized coal burner according to a third embodiment of the present invention.

FIG. 6 shows a third embodiment of the invention. In FIG. 6, the same component as shown in FIG. 1 is referred by the same symbol, and detailed description is not given here. The first actuator 54 to drive the rotary damper 42 is not shown in the figure. The adjustment and the operation of the secondary air intake hole 38 through the rotation of the rotary damper 42 are the same as the adjustment and the operation described in the first embodiment, and detailed description is not given here.

In the third embodiment, the sliding damper 52 is designed in a divided structure comprising a plurality of cylindrical members, and it is tried to diversify air regulation of the air regulator 36. In the figure, a case of the structure divided to two portions is shown.

The sliding damper 52 comprises a sliding damper 52*a* and the sliding damper 52*b*. The sliding damper 52*a* and the sliding damper 52*b* are designed in a multi-circular form and are freely slidable without interfering with each other. The sliding damper 52*a* and the sliding damper 52*b* are connected to a second actuator 53*a* and a second actuator 53*b* respectively, and the sliding damper 52*a* and the sliding damper 52*b* can be independently driven by the second actuator 53*a* and the second actuator 53*b* respectively.

Figure 7A:
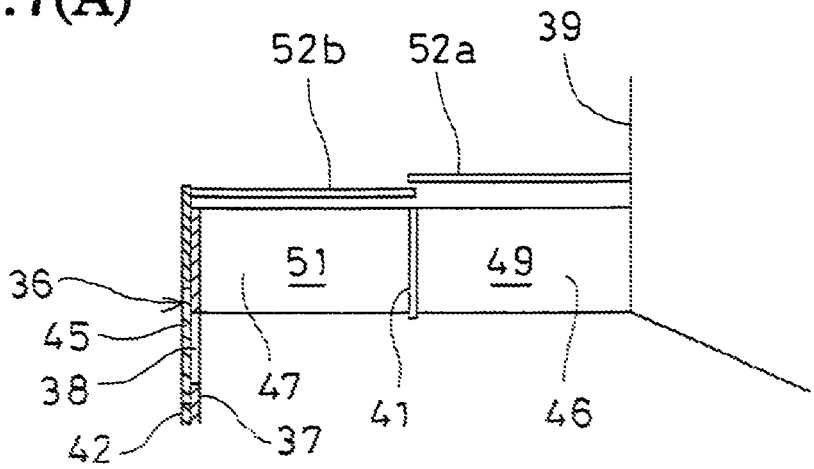
FIG. 7 (A), FIG. 7 (B) and FIG. 7 (C) each represents a drawing to explain operation of the third embodiment.
Figure 7B:
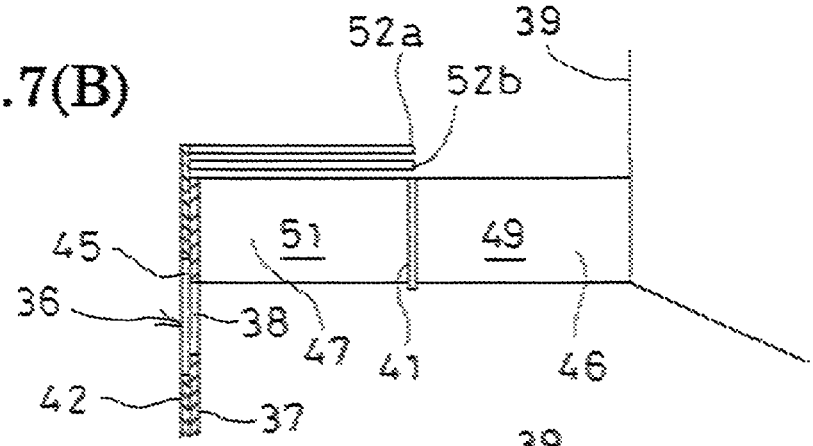
Figure 7C:
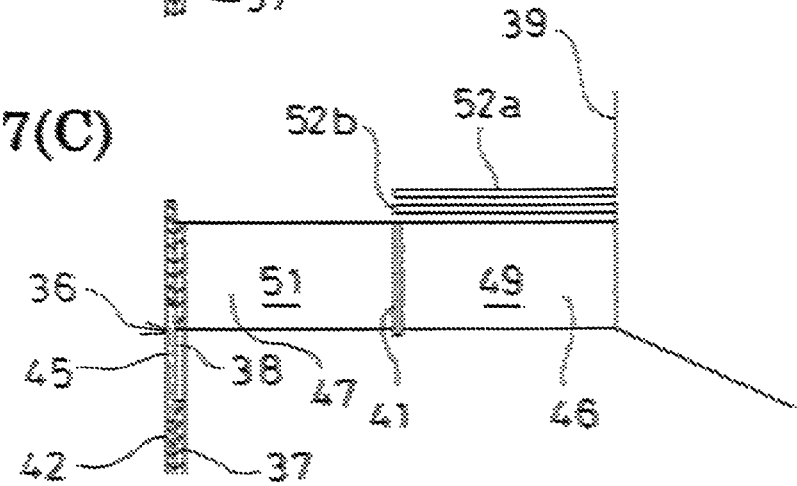

Next, referring to FIG. 7, description will be given on operation of the third embodiment.

The sliding damper 52*a* and the sliding damper 52*b* are stacked together and when the sliding damper 52*a* and the sliding damper 52*b* are synchronized and are moved integrally. Thereby, the same operation as the operation of the first embodiment can be achieved (see FIG. 7 (B) and FIG. 7 (C)).

Next, the furnace inner side air intake chamber 49 is blocked by the sliding damper 52*a*, and the furnace outer side air intake chamber 51 is blocked by the sliding damper 52*b*, the secondary air intake hole 38 is blocked by the rotary damper 42. Thereby, the air regulator 36 can be set in the totally closed condition (see FIG. 7 (A)).

This is a case where the combustion by the corresponding pulverized coal burner 15 is stopped. The supply of the secondary air 34 can be stopped by the air regulator 36.

The air regulator 36 has the function to stop the supply of the secondary air. Thereby, it is possible to eliminate the use of the damper 9 as shown in FIG. 10 and to simplify the facilities and the control system.

The sliding damper 52*a* and the sliding damper 52*b* are partially stacked together. Further, by adjusting the stacking allowance (margin), area of opening of each of the furnace inner side air intake chamber 49 and the furnace outer side air intake chamber 51 can be adjusted. As a result, the swirling degree and supply airflow rate can be adjusted at the same time.

Further, when a type of fuel with high combustibility is supplied, there is a case where the flame cannot be generated properly even when the furnace inner side air intake chamber 49 is blocked and the furnace outer side air intake chamber 51 is totally opened. In such case, by blocking the furnace inner side air intake chamber 49 and the furnace outer side air intake chamber 51 and by rotating the rotary damper 42, only the axial flow without swirling can be supplied to the throat 13.

Figure 8:
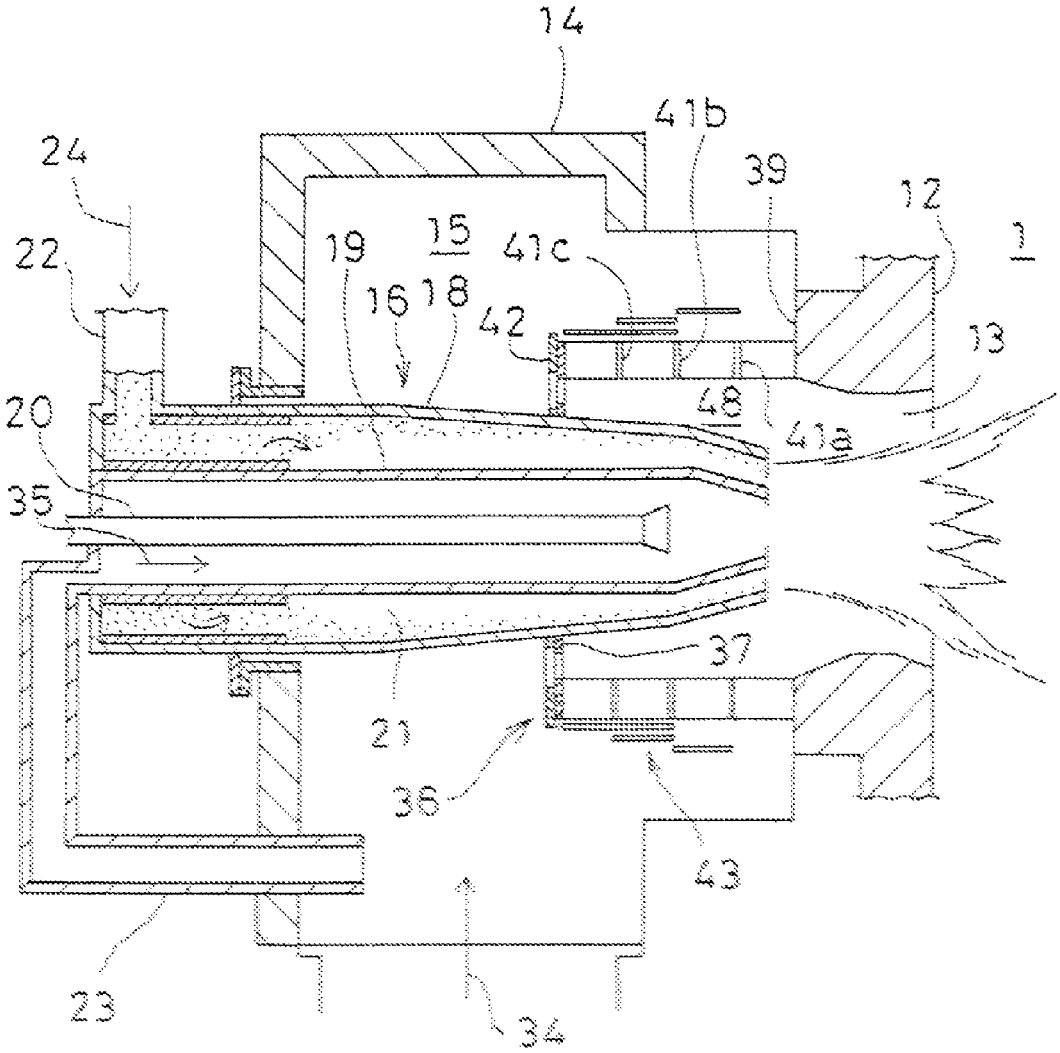
FIG. 8 is a schematical cross-sectional view to show a pulverized coal burner according to a fourth embodiment of the present invention.
Figure 9A:
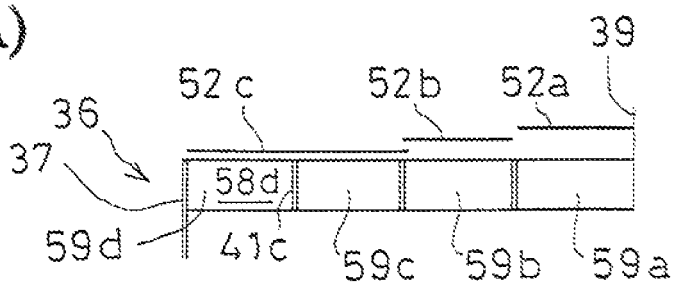
FIG. 9 (A), FIG. 9 (B), FIG. 9 (C), FIG. 9 (D), FIG. 9 (E), and FIG. 9 (F) each represents a drawing to explain operation in the fourth embodiment of the present invention.
Figure 9B:
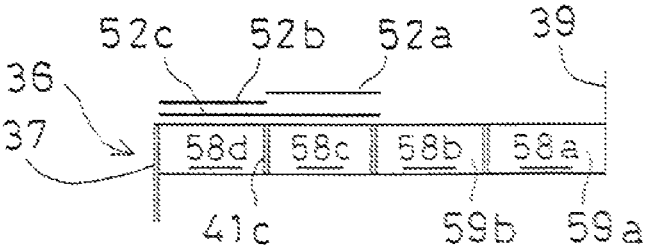
Figure 9C:
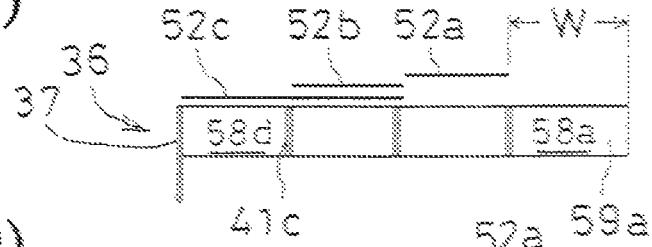
Figure 9D:
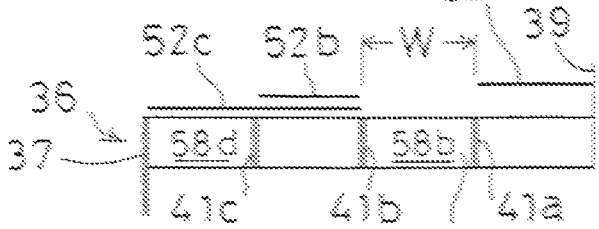
Figure 9E:
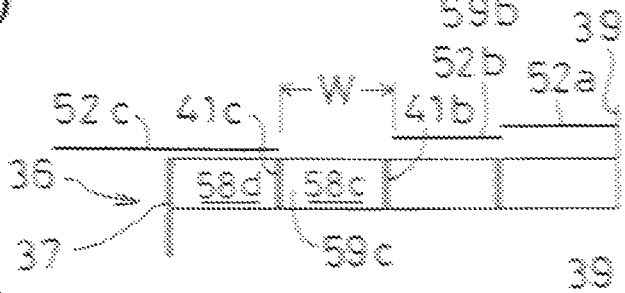
Figure 9F:
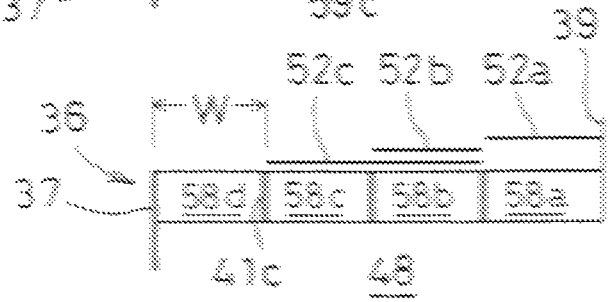

FIG. 8 shows a fourth embodiment of the invention. In FIG. 8, the same component as shown in FIG. 1 is referred by the same symbol, and detailed description is not given here. The rotary damper 42 and a first actuator 54 to drive the rotary damper 42, and a second actuator 53 to drive the sliding damper 52 are not shown in the figure.

In the fourth embodiment, air regulating functions of the air regulator 36 are diversified further.

In the air regulator 36 according to the fourth embodiment, partition plates 41*a*, 41*b* and 41*c* are installed in the cylindrical space 48. The cylindrical space 48 is equally divided to four parts in the axial direction to form air intake chambers 58*a*, 58*b*, 58*c*, and 58*d* (See FIG. 9).

Air vanes 59*a*, 59*b*, 59*c* and 59*d* are mounted in the air intake chambers 58*a*, 58*b*, 58*c* and 58*d* respectively. Tilt angles $\gamma a$, $\gamma b$, $\gamma c$ and $\gamma d$ of the air vanes 59*a*, 59*b*, 59*c* and 59*d* respectively are set to have a relation of: $\gamma a<\gamma b<\gamma c<\gamma d$ so that the tilt angle will be gradually increased toward furnace outer side (i.e. swirling degree will be decreased).

The sliding damper 52 is designed in a structure divided in three parts, and the sliding damper 52 comprises sliding dampers 52*a* and 52*b*, each having axial length of ¼ of the cylindrical space 48, and a sliding damper 52*c*, having axial length of ½ of the cylindrical space 48.

The sliding dampers 52*a*, 52*b* and 52*c* are designed in a multi-circular circumferential structure and these are freely slidable without interfering with each other. Each of the sliding dampers 52*a*, 52*b* and 52*c* are separately connected to an actuator (not shown), and these sliding dampers can be slid independently by the driving of each individual actuator.

FIG. 9 (A) shows condition where the air regulator 36 is totally closed. The air intake chambers 58*a* and 58*b* are blocked by the sliding dampers 52*a* and 52*b* respectively, and the air intake chambers 58*c* and 58*d* are blocked by the sliding damper 52*c*.

As shown in FIG. 9 (B), when the sliding dampers 52*a* and 52*b* are stacked on the sliding damper 52*c*, the air intake chambers 58*a* and 58*b* are opened, and the secondary air 34, to which swirling is given by the air vanes 59*a* and 59*b*, is introduced into the throat 13. Because tilt angles are different between the air vanes 59*a* and 59*b*, the secondary air 34, which has an intermediate swirling degree between two grades of swirling degree as given by the air vanes 59*a* and 59*b* respectively, is introduced into the throat 13.

When the sliding dampers 52*a* and 52*b* are moved integrally toward furnace inner side while the sliding dampers 52*a* and 52*b* are stacked on the sliding damper 52*c*, and when the air intake chambers 58*a* and 58*b* are blocked and the air intake chambers 58*c* and 58*d* are opened, the secondary air 34, to which swirling is given by the air vanes 59*c* and 59*d*, is introduced into the throat 13. Because tilt angles are different between the air vanes 59*c* and 59*d*, the secondary air 34, which has the intermediate swirling degree between the two grades of swirling degree as given by the air vanes 59*c* and 59*d*, is introduced into the throat 13.

As shown in FIG. 9 (C), when the air intake chamber 58*b* is blocked by one of either the sliding damper 52*a* or the sliding damper 52*b* from condition shown in FIG. 9 (B) (by the sliding damper 52*a* in the figure), only the air intake chamber 58*a* is opened, and the secondary air 34 with the maximum swirling degree given by the air vane 59*a* is supplied into the throat 13.

When only the sliding damper 52 is moved backward under condition shown in FIG. 9 (C), opening width W is increased. As a result, the secondary air 34, which is passing through a part of each of the air intake chambers 58*a* and 58*b*, is supplied, and the supply airflow rate is increased.

As shown in FIG. 9 (D), when the sliding damper 52*a* is moved forward from the condition shown in FIG. 9 (C), and the air intake chamber 58*a* is blocked, only the air intake chamber 58*b* is opened. Then, the secondary air 34, to which the second highest swirling degree is given by the air vane 59*b*, is supplied to the throat 13.

When the sliding dampers 52*b* and 52*c* are integrally moved backward under condition shown in FIG. 9 (D), the opening width W is increased, and the secondary air 34, which has passed through a part of the air intake chamber 58*b* and a part of the air intake chamber 58*c*, is supplied, and the supply airflow rate is increased.

As shown in FIG. 9 (E), the sliding damper 52*b* is moved forward from the condition as shown in FIG. 9 (D), and the air intake chamber 58*b* is blocked. Then, the sliding damper 52*c* is moved backward, and the air intake chamber 58*c* is opened.

The secondary air 34 flows into the air intake chamber 58*c*. Then, the second weakest swirling degree is given to the secondary air by the air vane 59*c*, and the air is supplied to the throat 13.

When the sliding damper 52*c* is moved backward under condition shown in FIG. 9 (E), or when the sliding damper 52*b* is moved forward, or when the sliding damper 52*c* is moved backward and, at the same time, the sliding damper 52*b* is moved forward, the opening width W is increased. Then, the secondary air 34, which has passed through a part of the air intake chamber 58*c* and a part of each of the air intake chambers 58*b* and 58*d*, is supplied, and the supply airflow rate is increased.

As shown in FIG. 9 (F), when the sliding damper 52*c* is moved forward from the condition shown in FIG. 9 (E) so that the air intake chambers 58*c* and 58*b* are blocked by the sliding damper 52*c*, the air intake chamber 58*d* is opened.

When the secondary air 34 flows into the air intake chamber 58*d*, the weakest swirling degree is given to the secondary air 34 by the air vane 59*d*, and the air is supplied to the throat 13.

In this case, if it is wanted to increase the supply airflow rate, the sliding damper 52*c* is moved forward, and a part of the air intake chamber 58*c* is opened. The secondary air 34 passes through the air intake chamber 58*c*, and the swirling degree is given to the air by the air vane 59*c*, and the secondary air 34 joins the secondary air 34, which has passed through the air intake chamber 58*d*.

In the fourth embodiment, it may be so arranged that the partition plates 41*a*, 41*b* and 41*c* are removed and continuous air vane 59 is placed between the end plate 37 and the furnace wall outer surface 39, and that tilt angle of the air vane 59 is decreased on furnace core side, and the angle is gradually increased as the position is changed backward. In this case, the structure of the sliding damper 52 is unchanged.

Because opening positions of the air regulator 36 are different, the secondary air 34 passes through the portions with different tilt angles of the air vane 59. Thus, by changing the opening position of the air regulator 36, the swirling degree of the secondary air 34 can be adjusted. It is needless to say that airflow rate of the secondary air 34 and the swirling degree can be adjusted further by adjusting the opening of the secondary air intake hole 38 through rotation of the rotary damper 42.

In the fourth embodiment, the sliding damper 52 is divided into three parts, while the sliding damper 52 may be divided into four or more parts.

Because the tilt angles are different in the air vanes 59*a*, 59*b*, 59*c* and 59*d*, pressure losses are different in the air intake chambers 58*a*, 58*b*, 58*c* and 58*d*. Therefore, it may be so arranged that porous members with different numerical apertures are installed in the air intake chambers 58*a*, 58*b*, 58*c* and 58*d* so that pressure losses will be equal in the air intake chambers 58*a*, 58*b*, 58*c* and 58*d*.

It is needless to say that the present invention can be applied not only to the pulverized coal burner but also to the burner to use the fuel such as fuel oil or heavy oil.

The invention claimed is:

1. A burner, comprising a burner throat installed on a furnace wall, a nozzle main unit installed along the central axis of said burner throat, and a secondary air regulator installed at a forward end of said nozzle main unit and for supplying secondary air for combustion toward said burner throat, wherein said secondary air regulator comprises:

a cylindrical space which surrounds a forward end of said nozzle main unit and is communicated with the burner throat; and a first adjusting means in communication with the cylindrical space for supplying a part of the secondary air to the cylindrical space as a straight axial flow; and a second adjusting means in communication with the cylindrical space for supplying the remaining secondary air to the cylindrical space by giving a swirling degree, wherein said cylindrical space comprises outer and inner peripheral portions where an outer peripheral surface is open and the outer and inner peripheral portions are a continuous space, and an end plate is provided on an end surface on opposite side of said cylindrical space;

said second adjusting means comprises a partition plate for partitioning said outer peripheral portion in an axial direction into a plurality of small cylindrical spaces, and air vanes are installed at a predetermined distance along a circumferential direction for each of said small cylindrical spaces, a sliding damper surrounding said cylindrical space and being slidable in an axial direction, and a second driving means to make said sliding damper slide; and said first adjusting means installed on said end plate comprises holes communicating with said inner peripheral portion, and a rotary damper being capable to totally close said hole and capable to adjust opening of said hole, and a first driving means for rotating said rotary damper, wherein swirling secondary air, said swirling provided by said air vanes and flowing into said inner peripheral portion, and secondary air from axial direction, flowing into said inner peripheral portion through said holes, are mixed in said inner peripheral portion and secondary air comprising the swirling degree resulting from mixing swirling and axial flow is supplied to said burner throat.

2. A burner according to claim 1, wherein the swirling degree of said swirling secondary air is adjusted by adjusting a position of said sliding damper and the opening degree of said air hole, and the flow rate of said secondary air from axial direction are adjusted by adjusting rotational position of said rotary damper, and the swirling degree of secondary air supplied to said burner throat is adjusted by adjusting said positions of said sliding damper and said rotary damper individually.

3. A burner according to claim 2, wherein said air vanes have different tilt angles for each small cylindrical space, and a ratio of the secondary airflow rate into each small cylindrical member is adjusted according to a position of said sliding damper, and the swirling degree is regulated by the adjustment of the ratio.

4. A burner according to claim 3, wherein there is provided pressure adjusting means in other than said small cylindrical space where said air vanes have the smallest tilt angle among said small cylindrical spaces.

5. A burner according to claim 1, wherein pressure adjusting means is provided in a hole on said end plate.

6. A burner according to claim 1, wherein axial length of said sliding damper has such a length that at least one of said small cylindrical spaces is blocked.

7. A burner according to claim 1, wherein said sliding damper comprises a plurality of cylindrical members provided each in a concentrical multi-circular form, and each of said cylindrical members can slide independently from each other.

8. A burner according to claim 1, wherein said sliding damper can block said cylindrical space by said plurality of cylindrical members.

9. A burner according to claim 1, wherein said sliding damper comprises at least three cylindrical members which can be stacked together, each of said cylindrical members can slide independently from each other, and said cylindrical space can be opened at an arbitrary position and with an arbitrary width.

10. A burner according to claim 1, wherein said cylindrical space, being divided to three or more small cylindrical spaces by a plurality of partition plates, said air vanes are installed in each of said small cylindrical spaces, and said air vanes have different tilt angles for each of said small cylindrical spaces.

11. A burner according to claim 1, wherein said air vanes have different tilt angles for each of said small cylindrical spaces.

12. A burner according to claim 1, wherein said air vanes in each of said small cylindrical spaces are fixed in position.

13. A burner according to claim 3, wherein axial length of said sliding damper has such a length that at least one of said small cylindrical spaces is blocked.

14. A burner according to claim 2, wherein said sliding damper comprises a plurality of cylindrical members provided each in a concentrical multi-circular form, and each of said cylindrical members can slide independently from each other.

15. A burner according to claim 3, wherein said sliding damper comprises a plurality of cylindrical members provided each in a concentrical multi-circular form, and each of said cylindrical members can slide independently from each other.

16. A burner according to claim 2, wherein said sliding damper can block said cylindrical space by said plurality of cylindrical members.

17. A burner according to claim 3, wherein said sliding damper can block said cylindrical space by said plurality of cylindrical members.

18. A burner according to claim 2, wherein said sliding damper comprises at least three cylindrical members which can be stacked together, each of said cylindrical members can slide independently from each other, and said cylindrical space can be opened at an arbitrary position and with an arbitrary width.

19. A burner according to claim 3, wherein said sliding damper comprises at least three cylindrical members which can be stacked together, each of said cylindrical members can slide independently from each other, and said cylindrical space can be opened at an arbitrary position and with an arbitrary width.

* * * * *